US006840760B1

(12) United States Patent
Keller et al.

(10) Patent No.: US 6,840,760 B1
(45) Date of Patent: Jan. 11, 2005

(54) GAS-ASSISTED FLARE BURNER

(76) Inventors: Michael R. Keller, 7646e. 77th Ct., Tulsa, OK (US) 74133; Roger K. Noble, 3418 E. 63rd St., Tulsa, OK (US) 74136; John A. Simmer, 415 E. F St., Jenks, OK (US) 74037

( * ) Notice: Subject to any disclaimer, the term of this patent is extended or adjusted under 35 U.S.C. 154(b) by 0 days.

(21) Appl. No.: 10/640,193

(22) Filed: Aug. 13, 2003

(51) Int. Cl.[7] ..... F23D 14/00
(52) U.S. Cl. ..... 431/202; 431/4; 431/5; 431/190
(58) Field of Search ..... 431/202, 4, 5, 431/190, 3

(56) References Cited

U.S. PATENT DOCUMENTS

| | | | | | |
|---|---|---|---|---|---|
| 3,539,285 | A | * | 11/1970 | Reed et al. | 431/202 |
| 3,730,673 | A | * | 5/1973 | Straitz, III | 431/278 |
| 3,982,881 | A | * | 9/1976 | Schwartz et al. | 431/202 |
| 4,052,142 | A | | 10/1977 | Reed et al. | |
| 4,070,146 | A | | 1/1978 | Straitz, III | |
| 4,565,522 | A | * | 1/1986 | Schwartz | 431/202 |
| 4,643,669 | A | | 2/1987 | Bozai | |
| 4,952,137 | A | | 8/1990 | Schwartz et al. | |
| 5,649,820 | A | * | 7/1997 | Keller et al. | 431/202 |
| 5,823,759 | A | | 10/1998 | Swithenbank | |

* cited by examiner

*Primary Examiner*—Alfred Basichas
(74) *Attorney, Agent, or Firm*—Robert C. Brown

(57) ABSTRACT

An improved flare burner for burning combustible gases in petroleum and petrochemical installations. A cylindrical shell has a closed bottom and an open top. A central opening in the bottom is connectable to a source of the gas to be burned. A plurality of linear steam/gas tubes is disposed within the shell, each tube extending to the open end of the shell and also extending through the shell bottom. A lower steam distribution sub-assembly below the shell bottom includes individual steam jets adjacent the ends of the tubes for educting air to the upper end of the tube. A pilot gas sub-assembly for igniting the flare gas is disposed within the shell. Gas to be burned is passed into the interior of the shell through the bottom opening and moves to the open end. Steam injected into the steam/air tubes educts air, and air and steam exit the tubes and mix with the gas to create a combustible mixture. The pilot light assembly provides an open flame which ignites the mixture. The upper end of the shell is reinforced by a rolled collar. An upper steam distribution subassembly within the collar includes a manifold and jets extending beyond the collar to provide additional air and steam for combustion and prevent fires from overflowing the burner and becoming attached to the outside surface of the shell.

13 Claims, 3 Drawing Sheets

GAS-ASSISTED FLARE BURNER

TECHNICAL FIELD

The present invention relates to devices for burning gases; more particularly, to devices for burning gases emanating from petroleum refining or processing operations; and most particularly, to a gas-assisted flare burner having improved resistance to heat deformation and degradation and weather impairment, and increased reliability.

BACKGROUND OF THE INVENTION

Flare burners are well known in the art of petroleum processing and refining. See, for example, U.S. Pat. Nos. 4,052,142; 4,070,146; 4,643,669; 4,952,137; and 5,823,759. Typically, a flaring system is provided in a refinery or petrochemical plant to ensure the safe and efficient disposal of relieved gases or liquids, as may occur during normal plant operations or during emergency shutdown of such operations. The disposal fluids are collected in a flare header and routed to the burner. A flare burner is extremely important in the event of a plant emergency such as a fire or power failure, and a properly operating flare system is a critical component to prevent a plant disruption from turning into a disaster. A flare burner must always be available for flaring whenever a plant disruption occurs. A flare burner is expected to be operable twenty-four hours a day and typically must be in service for several years without a need to shut it down. A flaring system must reduce ground level concentrations of hazardous materials, provide safe disposal of flammable materials, and reduce volatile organic compound (VOC) and hydrocarbon emissions.

Flare burners typically are oriented to fire upward. The discharge point is in an elevated position relative to the surrounding grade and/or nearby equipment. Some flare burners, known in the art as enclosed flares, are constructed to conceal the flame from direct view, which can reduce noise and minimize heat and sound radiation. Multiple stages within the enclosed flares are sometimes used.

A single-point flare burner is an open pipe tip with a single gas exit point, and may be of the smokeless or non-smokeless design. Smokeless flares eliminate any noticeable smoke over a specified range of gas flows. Smokeless combustion is achieved by utilizing auxiliary air, steam, or other means to create turbulence and entrain air within the flared gas stream to improve combustion. The flame produced by a gas-assisted pipe flare burner is a function of the relief gas characteristics, the gas exit velocity, and the gas injection design. For economic reasons, steam is a currently-preferred gas for use in gas-assisted pipe flare burners. Compressed air or other high-pressure gases, including light molecular weight hydrocarbon vapors, can be used, but steam has been found to be the most cost-effective medium. Note, however, that as used herein, "steam" should be taken to mean any gas used for educting air into a flare burner.

Steam injection functions to produce smokeless combustion by educting combustion air into the combustion zone at the exit of the gas supply pipe, thus increasing momentum and turbulence in the flare flame. The combination of educted combustion air, momentum, and turbulence can produce short, intense flames.

Steam often is injected into the gas discharge at the top of a flare burner as well (see, for example, U.S. Pat. No. 4,643,669). Typically, a steam ring having a plurality of injection nozzles or slots is disposed on the outside of a burner shell, the nozzles angled inwards to draft air into the combustion zone. The steam and air act to dilute the hydrocarbon fuel content, which also reduces smoking tendency. The steam vapor can also participate in the combustion kinetics, assisting in the conversion of carbon to carbon monoxide.

In prior art flare burners, upper steam rings can be subject to flame impingement due to wind action. However, an upper steam ring also may function as a windshield to reduce adverse wind effects on the flare flame and can also help to prevent undesirable flame attachment to the outer surface of a flare burner shell. Both of these problems are well known in the art. A flare burner that employs both internal steam/air tubes and an upper steam ring may have more than twice the maximum smokeless burning capacity of an upper steam ring flare. The steam/air discharge from the internal tubes can also be at a high velocity, in some burners approaching Mach 1, adding to the momentum of the flare discharge and inspirating additional combustion air while stiffening and shortening the flame.

Back burning is a potential hazard with prior art steam/air tube flare burners. Care must be taken to avoid back flow of combustible mixtures into the internal tubes and feed pipe. The most common cause of back flow in the tubes is improper flare operation. If the upper steam ring is pressurized prior to engaging the steam supply to the steam/air tubes, the upper steam can cap the top of the flare discharge and force flow backward out of the steam eductor tubes.

Prior art gas-assisted flare burners are subject to numerous well-known shortcomings which can affect performance and working life of a flare burner. For example, the upper steam ring and steam supply piping typically are welded via brackets to the outside of the burner shell, which in use can result in severe thermal distortion and fracture of the ring and/or shell. Typically, the shell is not especially reinforced at the upper end and thus is vulnerable to such distortion. Temperature differentials of many hundred degrees may be produced over a distance of only a few inches. An upper steam distribution ring and steam injectors on the outside of the shell can also provide anchor points for uncontrolled fires on the outside of the burner shell, and may actually incite such fires through turbulence of air and gas around the steam ring.

Further, prior art steam/air tubes are entered into the burner diagonally through openings in the shell sidewall and include welded elbow turns of 30–60° within the shell, which elbows reduce air eduction rates significantly and are also known to fracture from thermal and vibratory stress. As noted above, gas flow rates through the tubes can approach Mach 1, creating great stress on the tubes and especially on the elbows therein. Also, this arrangement requires a large and cumbersome steam injection assembly surrounding the inlet ends of the tubes where they protrude through the sidewall of the shell. Also, the number of tubes within the burner shell is limited by this arrangement, and relatively few tubes are provided toward the center of the burner. Thus the lateral distribution of educted air within the flare is non-uniform.

Further, a pilot ignition system typically is attached by welded brackets onto the outer surface of the shell near the upper edge, along with the steam ring, which can also result in thermal distortions and uncontrolled burning outside the shell.

Further, under conditions of low gas flow, the velocity of the air gas mixture at the flare outlet can be insufficient to prevent turbulent re-entry of the mixture and the ignition front into the burner, creating a potentially explosive situation.

What is needed is a flare burner having increased resistance to fires outside the shell, less restrictive steam/air tubes, a robust pilot ignition system at the exit to the burner, and an improved gas velocity seal. What is further needed is a flare burner having all steam/air tubes and pilot ignition sub-assemblies disposed within the shell, having all straight steam/air tubes with no bends, and having no hardware welded or attached to the outside of the shell near the open end thereof.

It is a principal object of the present invention to increase the working lifetime of a flare burner.

It is a further object of the present invention to increase the reliability of a flare burner.

It is a still further object of the present invention to reduce the cost and complexity of a flare burner.

It is a still further object of the present invention to improve the mechanical durability of a flare burner.

SUMMARY OF THE INVENTION

Briefly described, an improved flare burner in accordance with the invention includes a cylindrical shell having a closed bottom and an open top. A central opening in the bottom is connected to a source of gas to be burned. A plurality of linear steam/gas tubes are disposed within the shell, each tube having a first portion extending to the open end of the shell and a second portion extending through the shell bottom. Preferably, each tube is linear, having no bends, and is disposed generally parallel with the axis of the shell. A lower steam distribution sub-assembly is disposed below the shell bottom and includes an individual steam jet adjacent to the open end of each linear tube for educting air from below the burner through the tube to the upper end of the tube. At least one pilot gas sub-assembly for igniting the flare gas is disposed within the shell, having a gas pilot valve connected to a source of flammable gas and attached to a pilot tube at its lower end, and a burner nozzle disposed at the upper end of the pilot tube adjacent the upper ends of the steam/air tubes. Preferably, a plurality of such pilot gas sub-assemblies, for example, three, is provided and distributed generally symmetrically among the steam/gas tubes.

In operation, gas to be burned is passed into the interior of the shell through the bottom central opening and expands laterally to fill the full width of the shell as it surrounds the steam/air tubes and moves axially of the shell toward the open end. Steam is injected at high velocity from the steam manifold into the linear steam/air tubes whereby air is entrained from the lower end to the upper end of each of the tubes. Air and steam exit the upper ends of the tubes and mix with the gas flowing out of the open end of the shell to create a combustible mixture. The pilot light assembly provides an open flame at the pilot nozzle which ignites the mixture.

The upper end of the shell is reinforced by a generally circular collar, rolled outwards and formed of heavy-gauge metal to provide dimensional stability for the burner gas exit against the heat generated by the burning gas. Preferably, an upper steam distribution sub-assembly is disposed within the collar and includes a ring-shaped steam manifold and secondary steam jets extending beyond the collar to groom the flame, to provide additional air and steam for combustion, and to prevent fire from overflowing the burner and becoming attached to the outside surface of the shell. Additionally, locating the steam manifold within the collar shields the manifold from the effects of flame impingement and thus extends the life of the manifold. Further, such locating eliminates the prior art anchor points for uncontrolled fires on the outside of the shell and greatly reduces susceptibility of the flare burner to the effects of winds on the flame.

The burner shell may be further provided with a generally concentric noise muffler disposed concentrically with the shell at a distance therefrom.

BRIEF DESCRIPTION OF THE DRAWINGS

The present invention will now be described, by way of example, with reference to the accompanying drawings, in which.

DESCRIPTION OF THE PREFERRED EMBODIMENTS

The improvements and benefits afforded by the invention may be better appreciated by first considering a prior art flare burner.

Figure 1:
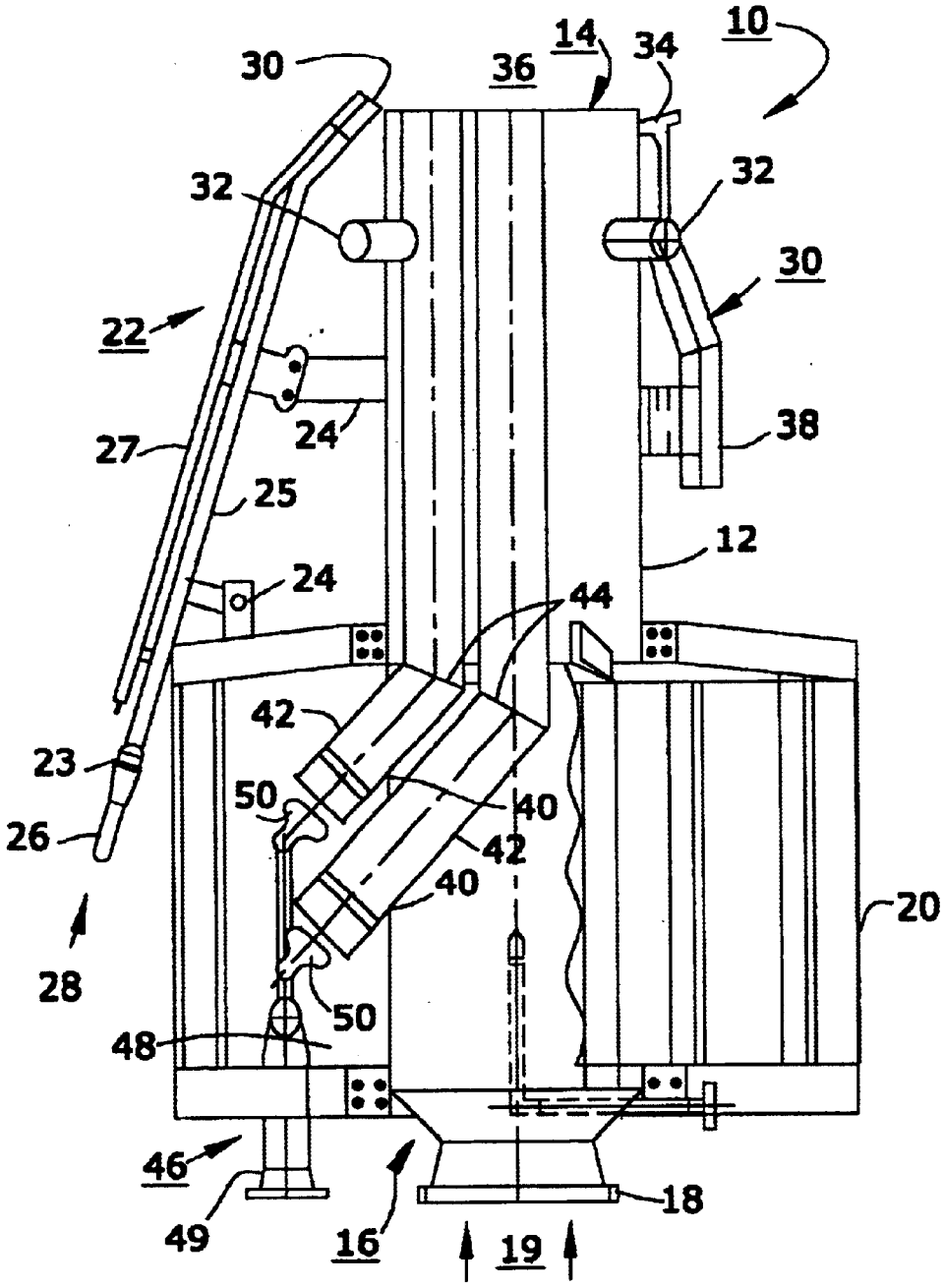
FIG.1 PRIOR ART
FIG. 1 is an elevational cross-sectional view of a prior art flare burner.

Referring to FIG. 1, a prior art flare burner assembly 10 includes a generally cylindrical shell 12 having an open upper end 14 and a lower end 16 adapted via a fitting 18 for connection to a source (not shown) of gas 19 to be burned, which gas enters shell 12 via fitting 18 during operation of burner 10. Surrounding shell 12 and welded thereto is a cage structure 20 for supporting shell 12 and providing means for mounting burner assembly 10 to a stack structure (not shown). Assembly 10 includes a pilot ignition sub-assembly 22 attached to shell 12 and cage structure 20 via brackets 24 welded to shell 12. Sub-assembly 22 is connectable via a fitting 26 to a source (not shown) of combustible gas 28 which may be the same as gas 19 or not. Pilot ignition sub-assembly 22 includes a gas valve 23, a pilot gas tube 25, and a pilot air tube 27, and has an exit tip 30 adjacent open end 14 and means for igniting gas 28 to produce a pilot light (not shown) which in turn ignites gas 19 at open end 20 after gas 19 is mixed with air as described below.

Surrounding shell 12 and welded thereto is an upper, or secondary, steam distribution sub-assembly 30 including an upper ring-shaped steam manifold 32 supporting a plurality of secondary steam jets 34 for educting air into the combustion zone 36 immediately above open end 14. Manifold 32 is supplied with steam from a conventional source (not shown) via feed pipe 38.

Disposed within shell 12 and extending through sidewall apertures 40 are a plurality of angled steam eductor tubes 42. Each of tubes 42 is open at both ends and includes an angle or elbow 44 having an included angle of, typically, about 120°. Surrounding shell 12 and supported by cage 20 is a lower, or primary, steam distribution sub-assembly 46 including a lower ring-shaped steam manifold 48 and steam riser 49 supporting a plurality of primary steam jets 50 for educting air into tubes 42, whence air is passed to combustion zone 36 for mixture with gas 19 and subsequent ignition of the mixture. Manifold 48 is supplied with steam from a conventional source (not shown) via feed pipe 52. (In FIG. 1, only two of tubes 42 are shown, but it should be appreciated that many more such tubes are present, exiting through additional apertures 40 around the entire periphery of shell 12 and supplied with an equal number of lower steam jets 50 spaced along ring manifold 48.)

Figure 2:
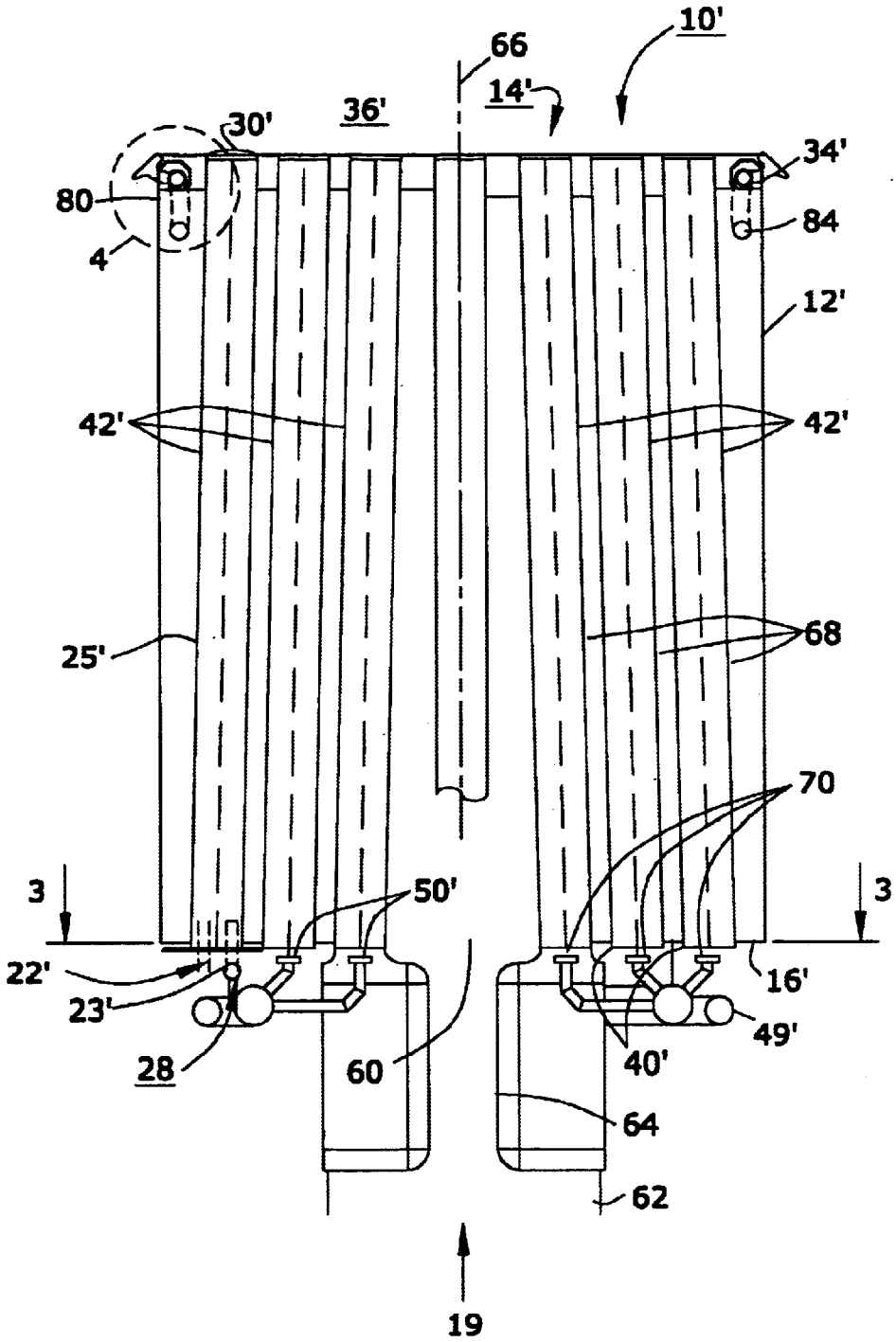
FIG. 2 is an elevational cross-sectional view of a flare burner in accordance with the invention.
Figure 4:
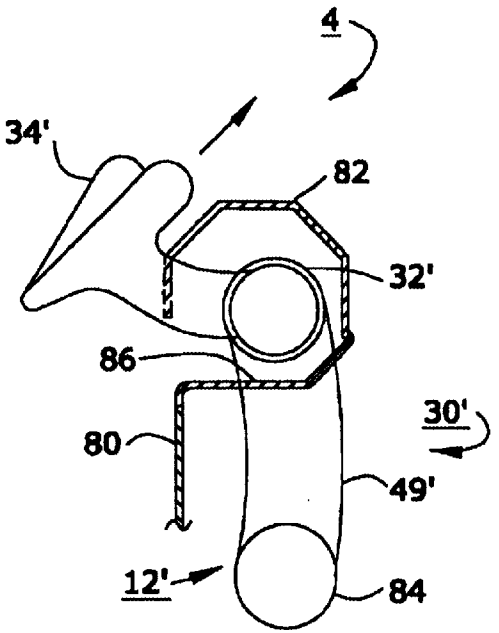
FIG. 4 is a detailed cross-sectional view of a rolled collar and secondary steam distribution sub-assembly, taken in circle 4 in FIG. 2.
Figure 3:
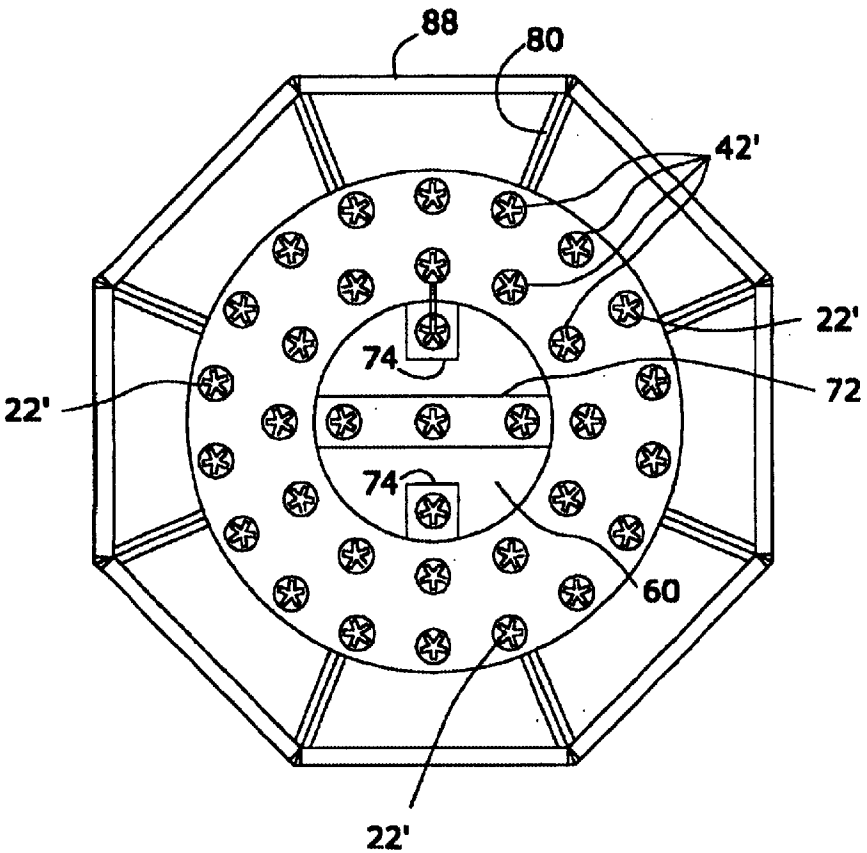
FIG. 3 is an equatorial cross-sectional view of the flare burner shown in FIG. 2, taken along line 3—3.

Referring to FIGS. 2 through 4, an improved flare burner 10' in accordance with the invention includes a cylindrical shell 12' having a closed bottom 16' and an open top 14'. A central opening. 60 in bottom closure 16' is connected to a source of gas 19 to be burned. Preferably, connecting pipe 62 includes a necked portion 64 immediately outside bottom 16', the necked portion being a pipe region of smaller diameter and therefore higher gas flow velocity defining thereby a "velocity seal" against backflow of explosive gas mixture from above the burner at times, of generally low gas flow through the burner. A plurality of linear steam/gas tubes 42' are disposed within shell 12' generally parallel with the axis 66 of shell 12', and preferably slightly converging as shown in FIG. 2, each tube 42' having a first portion 68 extending to the open end 14' of the shell and a second portion 70 extending through apertures 40' in shell bottom 16'. Preferably the tubes are arranged in generally concentric rings as shown in FIG. 3. A distinguishing feature of tubes 42' is that, unlike prior art angled steam/air tubes 42, the improved tubes are linear and have no bends or welded angles and thus provide minimum flow restriction for steam and air because the steam and air are provided through the bottom of the shell rather than through its sides as in the prior art. Removing the prior art 120° angle increases steam/air flow through the tubes by about 15% and removes an important prior art source of burner failure. Another distinguishing feature is that some of steam/air tubes 42' are provided and supported within gas entry opening 60 via a bridge element 72 and/or individual brackets 74, such that tubes, and therefore combustion air, can be provided to the flame substantially uniformly over the entire cross-sectional area of the shell. Preferably, tubes 42' are formed by centrifugal casting and have a heavy gauge wall to resist thermal deformation.

A primary and lower steam distribution sub-assembly 46' is disposed below shell bottom 16' and includes a ring-shaped manifold 48' connected to a steam riser 49' and an individual steam jet 50' adjacent to the open end of each linear tube 42' for educting air from below the burner through the tube to the upper end of the tube. A combustion zone 36' is defined in the free region immediately adjacent the upper ends of the tubes. At least one pilot gas sub-assembly 22' for igniting the flare gas is disposed within shell 12', having a gas pilot valve 23' connected to a source of flammable gas 28 and attached to a pilot tube 25' at its lower end, and a burner nozzle 30' disposed at the upper end of pilot tube 25' adjacent the upper ends of the steam/air tubes. Preferably, a plurality of such pilot gas sub-assemblies 22', for example, three, are provided and distributed generally symmetrically among the steam/gas tubes, as shown in FIG. 3.

In operation, gas 19 to be burned is passed into the interior of shell 12' through bottom central opening 60 and expands to fill the shell as it surrounds steam/air tubes 42' and moves axially of the shell toward open end 14'. Steam is injected at high velocity from primary steam manifold 49' via primary steam jets 50' into linear steam/air tubes 42' wherein air is entrained from the lower end to the upper end of each of the tubes. Air and steam exit the upper ends of the tubes and mix with gas 19 flowing out of the open end 14' of the shell to create a combustible mixture. Pilot light sub-assemblies provide open flames at the pilot nozzles 30' which ignite the mixture.

Referring to FIGS. 2 and 4, the upper end 80 of shell 12' is reinforced by a generally circular collar 82 welded to the shell and rolled outwards and formed of heavy-gauge metal to provide added hoop strength for increased dimensional stability of the shell at the burner gas exit against the heat generated by the burning gas. Preferably, a secondary and upper steam distribution sub-assembly 30' includes a ring-shaped steam manifold 32' disposed within collar 82 and secondary steam jets 34' extending beyond collar 82 to groom the flame, provide additional air and steam for combustion, and prevent fires from overflowing the burner and becoming attached to the outside surface of the shell. Preferably, second steam distribution manifold 32' is a generally ring-shaped element formed of a plurality of individual arc-shaped elements, each of which is supplied independently with steam from an additional ring-shaped manifold 84 disposed within shell 12' and connected to manifold elements 32' by a plurality of risers 49'. Preferably, four such arc-shaped elements and four risers are employed, each element subtending a central angle of about 900, and the elements being joined by slip fit to permit thermal expansion, and the risers extending through openings 86 in collar 82.

The flare burner shell may be further provided with a noise muffler 88 disposed concentrically with the shell at a distance therefrom (muffler omitted from FIG. 2 for clarity). Muffler may be supported on brackets 90 extending outwards from shell 12'. The brackets are attached to the exterior of the shell at an appropriate axial distance from open end 14' to avoid the above-mentioned prior art thermal-stress and fire-overflow problems arising from attaching hardware to the shell near the upper end.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A flare burner for burning combustible gases, comprising:

a) an elongate shell having a bottom closure at a first end and being open at a second and opposite end, said bottom closure having a first opening for entry of said combustible gases into said shell;

b) a plurality of steam/air tubes having first and second end portions, said steam/air tubes being disposed within said shell and being distributed substantially uniformly over the entire cross-sectional area of said shell and having said first end portions extending through a plurality of second openings in said bottom closure and having said second portions extending toward said shell open end;

c) first steam injector means disposed adjacent said first steam/air tube end portions for educting air through said steam/air tubes to said open end of said shell to form a combustible mixture with said combustible gases adjacent said open end of said shell; and d) means for igniting said combustible mixture.

2. A flare burner in accordance with claim 1 wherein said steam/air tubes are linear.

3. A flare burner in accordance with claim 1 further comprising a reinforcing collar disposed on said shell at said open end thereof.

4. A flare burner in accordance with claim 3 wherein said collar is rolled outwards of said flare burner.

5. A flare burner in accordance with claim 3 further comprising second steam injector means including second steam distribution means disposed within said collar.

6. A flare burner in accordance with claim 5 wherein said second steam injector means includes a plurality of steam injectors extending from said second steam distribution means for injecting steam into a region adjacent said open end of said shell.

7. A flare burner in accordance with claim 5 wherein said second steam distribution means comprises a generally ring-shaped element formed of a plurality of individual arc-shaped elements, each of said arc-shaped elements being supplied independently with steam.

8. A flare burner in accordance with claim 7 comprising four arc-shaped elements, each element subtending a central angle of about 90°.

9. A flare burner in accordance with claim 1 further comprising inlet means attached to said shell bottom closure at said first opening, said inlet means including a reduced-diameter necked portion of an inlet pipe for forming a region of higher gas velocity in said inlet pipe, defining thereby a velocity seal against gas backflow into said pipe.

10. A flare burner in accordance with claim 1 wherein said means for igniting comprises at least one pilot ignition sub-assembly, including:

a) a pilot tube having first and second ends and extending from below said closure at said first pilot tube end to about said second end of said shell at said second pilot tube end;

b) a gas pilot valve connected to a source of flammable gas and attached to said first pilot tube end; and c) a burner nozzle attached to said second pilot tube adjacent said upper ends of said steam/air tubes.

11. A flare burner in accordance with claim 1 wherein at least one of said steam/air tubes is disposed and supported within said shell by means extending into said gas entry opening.

12. A flare burner in accordance with claim 1 wherein said shell is cylindrical.

13. A flare burner in accordance with claim 1 wherein said steam/air tubes are formed by centrifugal casting.

* * * * *